US011322085B1

(12) United States Patent
Zheng

(10) Patent No.: US 11,322,085 B1
(45) Date of Patent: May 3, 2022

(54) PIXEL CIRCUIT AND DISPLAY PANEL

(71) Applicant: WUHAN CHINA STAR OPTOELECTRONICS SEMICONDUCTOR DISPLAY TECHNOLOGY CO., LTD., Wuhan (CN)

(72) Inventor: Yuan Zheng, Wuhan (CN)

( * ) Notice: Subject to any disclaimer, the term of this patent is extended or adjusted under 35 U.S.C. 154(b) by 218 days.

(21) Appl. No.: 16/767,127

(22) PCT Filed: Apr. 7, 2020

(86) PCT No.: PCT/CN2020/083571

§ 371 (c)(1),
(2) Date: May 27, 2020

(87) PCT Pub. No.: WO2021/179382

PCT Pub. Date: Sep. 16, 2021

(30) Foreign Application Priority Data

Mar. 12, 2020 (CN) ..... 202010170153.6

(51) Int. Cl.
*G09G 3/3233* (2016.01)

(52) U.S. Cl.
CPC ... *G09G 3/3233* (2013.01); *G09G 2300/0842* (2013.01); *G09G 2310/061* (2013.01); *G09G 2310/08* (2013.01)

(58) Field of Classification Search
CPC ..... G09G 3/3233; G09G 2300/0842; G09G 2310/061; G09G 2310/08
See application file for complete search history.

(56) References Cited

U.S. PATENT DOCUMENTS

| | | | |
|---|---|---|---|
| 2004/0183758 | A1 | 9/2004 | Chen et al. |
| 2005/0200575 | A1 | 9/2005 | Kim et al. |
| 2010/0220093 | A1 | 9/2010 | Choi |
| 2013/0043802 | A1 | 2/2013 | Han et al. |
| 2018/0033365 | A1 | 2/2018 | Leung et al. |
| 2018/0218681 | A1 | 8/2018 | Cai |
| 2019/0114960 | A1 | 4/2019 | Lee et al. |

FOREIGN PATENT DOCUMENTS

| | | | |
|---|---|---|---|
| CN | 102956192 | A | 3/2013 |
| CN | 102956199 | A | 3/2013 |
| CN | 102982766 | A | 3/2013 |
| CN | 103150992 | A | 6/2013 |
| CN | 104867441 | A | 8/2015 |
| CN | 105096819 | A | 11/2015 |
| CN | 106205495 | A | 12/2016 |
| CN | 107507567 | A | 12/2017 |
| CN | 110675815 | A | 1/2020 |
| JP | 2004287376 | A | 10/2004 |
| JP | 4396848 | B2 | 1/2010 |
| KR | 20080001482 | A | 1/2008 |
| KR | 20170132598 | A | 12/2017 |

*Primary Examiner* — Jeff Piziali

(57) ABSTRACT

A pixel circuit is provided, which includes a switching unit, a driving unit, a first light-emitting control unit, a second light-emitting control unit, a light-emitting unit, a storage unit, a voltage dividing unit, a reset unit, and a compensation unit. In the pixel circuit provided by the embodiment of the disclosure, the compensation unit, which is not limited to a duty cycle of a switching unit, can independently compensate a threshold voltage of the driving unit during a duty cycle of the compensation signal, and is suitable for high frequency pixel driving.

11 Claims, 5 Drawing Sheets

PIXEL CIRCUIT AND DISPLAY PANEL

FIELD OF INVENTION

This disclosure relates to a field of display technology, in particular to a field of high frequency display technology, and more particularly to a pixel circuit and a display panel.

BACKGROUND OF INVENTION

At present, with rapid development of display technology, display applications have been integrated into all aspects of people's life. However, the homogeneity of the display applications is increasingly serious, and consumers' demand for high-quality display is also increasing. Therefore, high frequency display has always been sought after by consumers in the high-end display field. In the early stage, the high frequency display mainly focused on professional display fields and gaming applications. The requirements for high frequency in mobile applications are also increasing. Correspondingly, a high frequency display can bring a smooth user experience.

Conventional display modes include: liquid crystal display (LCD) display mode and organic light-emitting diode (OLCD) display mode. The difficulties in driving high frequency between both of the modes are different. It is more difficult for current-driven display represented by the OLED display mode to achieve high frequency driving than that of the LCD display mode. Currently, in order to ensure display quality of OLED display, a compensation circuit design is mostly used, and the working time limitation of the compensation circuit makes the application of the high frequency driving difficult. In the high frequency driving applications, progressive scanning time of each line of pixels is compressed, and compensation time is also compressed. That causes the compensation effect to be decreased, thereby resulting in poor display quality.

SUMMARY OF INVENTION

The disclosure provides a pixel circuit, which solves the drawbacks that a threshold voltage compensation of a pixel circuit in high frequency applications is limited by progressive scanning time, resulting in a decrease in the threshold voltage compensation effect.

A first object of the disclosure is to provide a pixel circuit. The pixel circuit includes a switching unit, a driving unit, a first light-emitting control unit, a second light-emitting control unit 40, a light-emitting unit, a storage unit, a voltage dividing unit, a reset unit, and a compensation unit. The switching unit is configured to output a received data signal according to the control of a scanning signal. The driving unit is connected to an output terminal of the switching unit for accessing and driving pixels according to the data signal. The first light-emitting control unit is connected with an input terminal of the driving unit for outputting a received power positive signal according to the control of a first light-emitting control signal. The second light-emitting control unit is connected with an output terminal of the driving unit for outputting the power positive signal according to the control of a second light-emitting control signal. The light-emitting unit is connected to an output terminal of the second light-emitting control unit and is connected to receive a power negative signal for display of the pixels. The storage unit is connected to the output terminal of the switching unit and the output terminal of the drive unit for storing a threshold voltage of the driving unit. The voltage dividing unit is connected to receive the power positive signal and connected with the output terminal of the driving unit for dividing a voltage of the storage unit. The reset unit is connected with the output terminal of the driving unit for pulling down a potential of the output terminal of the driving unit to a potential of a first reference signal according to the control of a reset signal. The compensation unit is connected to the output terminal of the switching unit, and is configured to output a received second reference signal according to a compensation signal to compensate the threshold voltage. Besides, a duty cycle of the scanning signal and a duty cycle of the compensation signal are in different time intervals.

Based on the first object, in a first embodiment of the first object, the switching unit comprises a first thin film transistor, a drain of the first thin film transistor is connected to receive the data signal, a gate of the first thin film transistor is connected to receive the scan signal, and a source of the first thin film transistor is connected to the driving unit.

Based on the first embodiment of the first object, in a second embodiment of the first object, the driving unit comprises a second thin film transistor. A gate of the second thin film transistor is connected to the source of the first thin film transistor, a drain of the second thin film transistor is connected to the output terminal of the first light-emitting control unit, and a source of the second thin film transistor is connected to an input terminal of the second light-emitting control unit.

Based on the second embodiment of the first object, in a third embodiment of the first object, the first light-emitting control unit comprises a third thin film transistor. A drain of the third thin-film transistor is connected to receive the power positive signal, a gate of the third thin-film transistor is connected to receive the first light-emitting control signal, and a source of the third thin-film transistor is connected to the drain of the second thin film transistor.

Based on the third embodiment of the first object, in a fourth embodiment of the first object, the second light-emitting control unit comprises a fourth thin film transistor. A drain of the fourth thin film transistor is connected to the source of the second thin film transistor, a gate of the fourth thin film transistor is connected to receive the second light-emitting control signal, and a source of the fourth thin film transistor is connected to an input terminal of the light-emitting unit.

Based on the fourth embodiment of the first object, in a fifth embodiment of the first object, the light-emitting unit comprises a light-emitting device. An input terminal of the light-emitting device is connected to the source of the fourth thin film transistor, and an output terminal of the light-emitting device is connected to receive the power negative signal.

Based on the fifth embodiment of the first object, in a sixth embodiment of the first object, the storage unit comprises a first capacitor. A first terminal of the first capacitor is connected to the gate of the second thin film transistor, and a second terminal of the first capacitor is connected to the source of the second thin film transistor.

Based on the sixth embodiment of the first object, in a seventh embodiment of the first object, the voltage dividing unit comprises a second capacitor. A first terminal of the second capacitor is connected to receive the power positive signal, and a second terminal of the second capacitor is connected to the second terminal of the first capacitor.

Based on the seventh embodiment of the first object, in an eighth embodiment of the first object, the compensation unit comprises a fifth thin film transistor. A drain of the fifth thin film transistor is connected to receive the first reference signal, a gate of the fifth thin film transistor is connected to receive the compensation signal, and a source of the fifth thin film transistor is connected to the first terminal of the first capacitor.

In a second object, the disclosure provides a display panel, which includes the pixel circuit in any of the above-mentioned embodiments.

Advantageous effects of the disclosure are as follows. The disclosure provides a pixel circuit. The compensation unit can independently compensate the threshold voltage of the driving unit during the duty cycle of the compensation signal. Besides, the compensation unit is not limited to the duty cycle of the switching unit, which can improve the compensation effect of the threshold voltage and is suitable for driving the high frequency pixels.

DETAILED DESCRIPTION OF PREFERRED EMBODIMENTS

In order to more clearly illustrate the embodiments of the disclosure or the technical solutions in the prior art, the following briefly introduces the accompanying drawings used in the embodiments. However, the drawings are only provided for reference and description, and are not intended to limit the scope of the disclosure.

Figure 1:
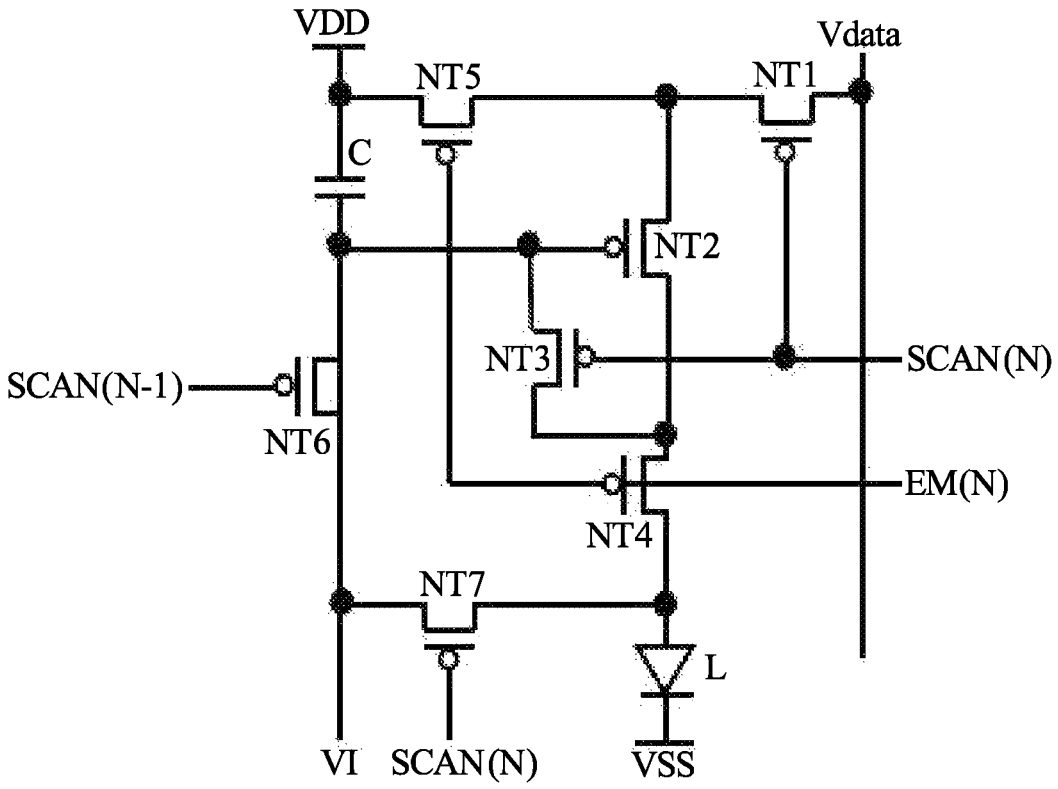
FIG. 1 is a circuit schematic diagram of a conventional pixel circuit.
Figure 2:
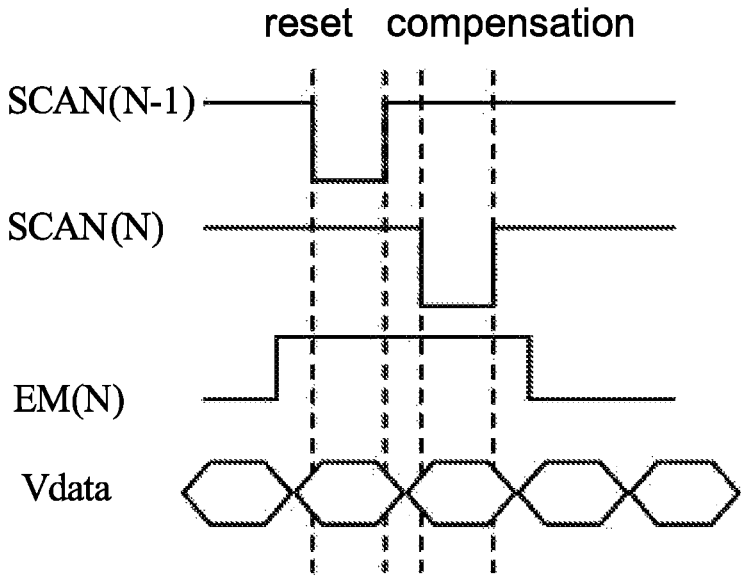
FIG. 2 is a timing schematic diagram of the conventional pixel circuit according to FIG. 1.

In order to better understand the intent of the disclosure, a pixel circuit of conventional technology will now be analyzed in combination with FIG. 1 and FIG. 2 as follows:

The pixel circuit is a commonly used 7T1C topology, and its working process can be divided into the following three stages.

Reset stage: The scan signal SCAN (N-1) of the N-1 stage is at a low potential level, the transistor NT6 is turned on, the low potential signal VI is connected to be received by the pixel circuit, and the capacitor C starts to discharge.

Data reading stage: The N scan signal SCAN (N) is at a low potential level, the transistor NT3 and the transistor NT1 are turned on. A source and a drain of the transistor NT2 are short-circuited, and the transistor NT2 functions as a diode until a gate potential of the transistor NT2 changes into the voltage Vdata of a data signal and an absolute value of a threshold voltage of the transistor NT2. Meanwhile, the transistor NT7 is turned on to reset the light-emitting device L.

Light-emitting stage: the light-emitting control signal EM(n) is at a low potential level, the transistor NT4 and the transistor NT5 are turned on, and the light-emitting device L performs pixel display.

As mentioned above, the data reading in the pixel circuit of the 7T1C topology and the threshold voltage compensation of the transistor NT2 can be performed simultaneously. That is to say, the threshold voltage compensation is limited to a time period of data reading. Therefore, the time period of data reading will be shortened when driving at a higher frequency. Correspondingly, the time period for threshold voltage compensation will be shortened accordingly, thereby reducing the effect of threshold voltage compensation.

The disclosure provides a pixel circuit. The compensation unit can independently compensate the threshold voltage of the driving unit during the duty cycle of the compensation signal. Besides, the compensation unit is not limited to the duty cycle of the switching unit, which can improve the compensation effect of the threshold voltage and is suitable for driving the high frequency pixel. The following description will be conducted in combination with the embodiment.

Figure 3:
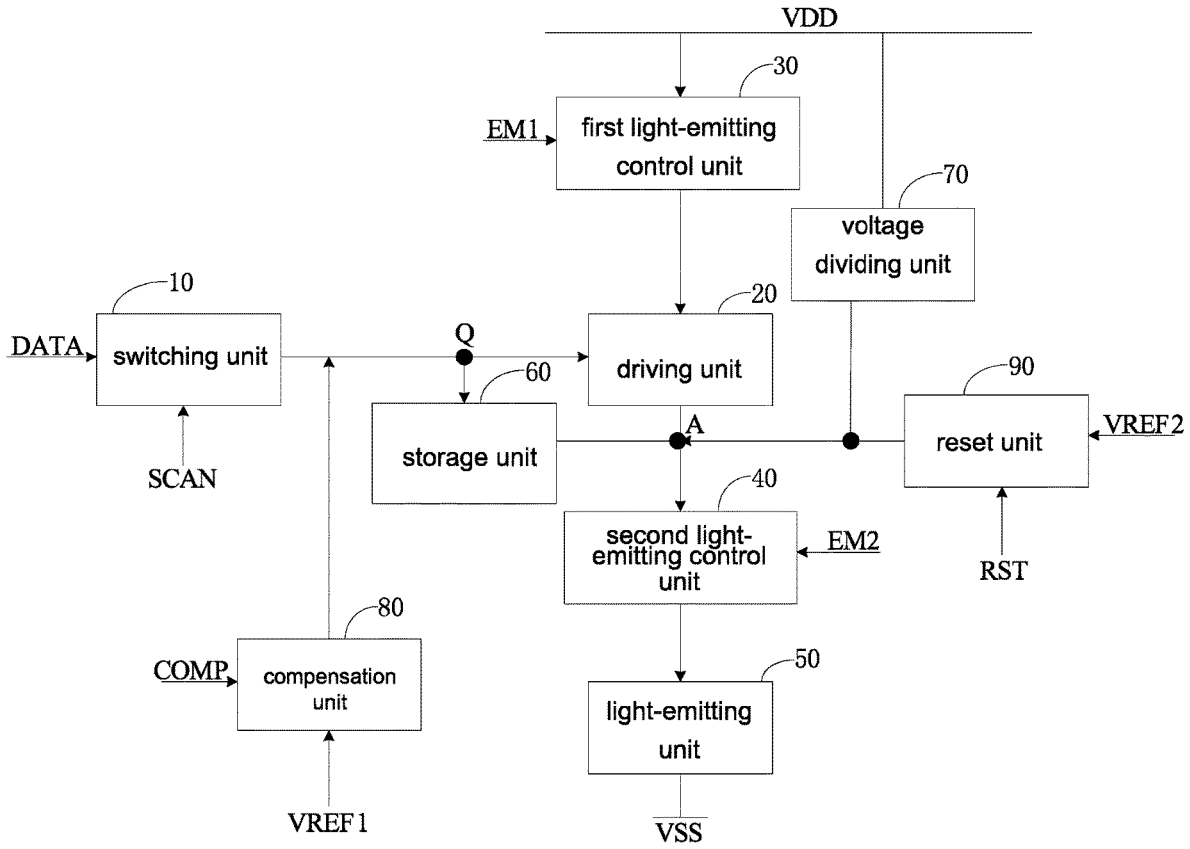
FIG. 3 is a schematic diagram of a first structure of a pixel circuit according to an embodiment of the disclosure.

Referring to FIG. 3, this embodiment provides a pixel circuit. The pixel circuit includes a switching unit 10, a driving unit 20, a first light-emitting control unit 30, a second light-emitting control unit 40, a light-emitting unit 50, a storage unit 60, a voltage dividing unit 70, a reset unit 90, and a compensation unit 80. The switching unit 10 is configured to output a received data signal DATA according to the control of a scanning signal SCAN. The driving unit 20 is connected to an output terminal of the switching unit 10 for accessing and driving pixels according to the data signal DATA. The first light-emitting control unit 30 is connected with an input terminal of the driving unit 20 for outputting a received power positive signal VDD according to the control of a first light-emitting control signal EM1. The second light-emitting control unit 40 is connected with an output terminal of the driving unit 20 for outputting the power positive signal VDD according to the control of a second light-emitting control signal EM2. The light-emitting unit 50 is connected to an output terminal of the second light-emitting control unit and connected to receive a power negative signal VSS for display of the pixels. The storage unit 60 is connected to the output terminal of the switching unit 10 and the output terminal of the drive unit 20 for storing a threshold voltage of the driving unit 20. The voltage dividing unit 70 is connected to receive the power positive signal VDD and is connected with the output terminal of the driving unit 20 for dividing a voltage of the storage unit 60. The reset unit 90 is connected with the output terminal of the driving unit 20 for pulling down a potential of the output terminal of the driving unit 20 to a potential of a first reference signal VREF1 according to the control of a reset signal RST. The compensation unit 80 is connected to the output terminal of the switching unit 10, and is configured to output a received second reference signal VREF2 according to a compensation signal COMP to compensate the threshold voltage. Besides, a duty cycle of the scanning signal SCAN and a duty cycle of the compensation signal COMP are in different time intervals.

It should be noted that the switching unit 10 and the compensation unit 80 are configured as two mutually independent modules, which can both adjust the storage unit 60, and the duty cycles of the scan signal SCAN and the compensation signal COMP, which sequentially control the two units, are not the same. Therefore, the threshold voltage of the compensation unit 80 for the driving unit 20 stored in the storage unit 60 may not be limited to the duty cycle of the switching unit 10. Therefore, the threshold voltage of the driving unit 20 can be better compensated. Moreover, compensation time and compensation value can also be controlled, which is suitable for driving high frequency pixels.

Figure 4:
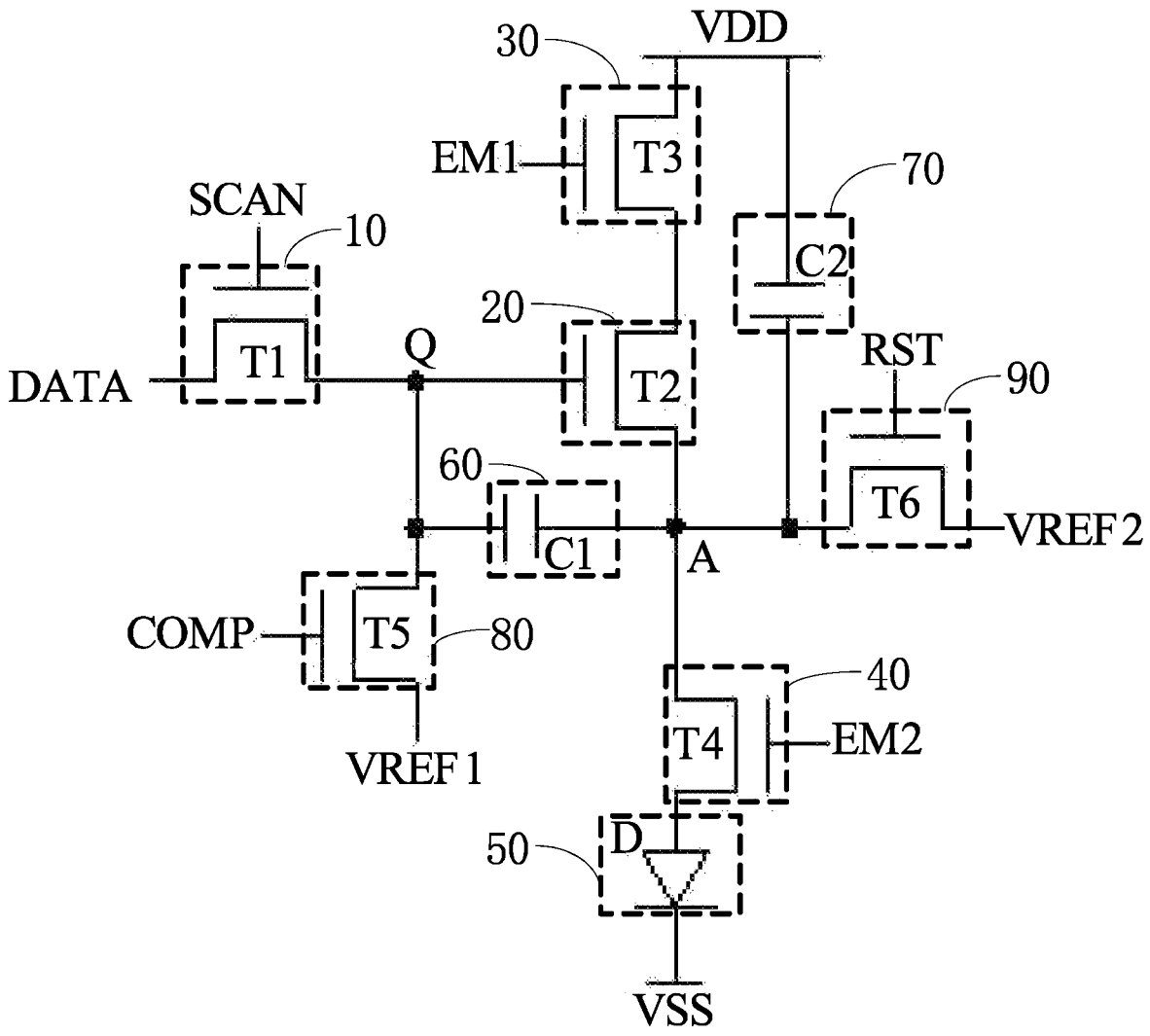
FIG. 4 is a circuit schematic diagram of the pixel circuit according to FIG. 3.

Referring to FIG. 4, in one of the embodiments, the switching unit 10 comprises a first thin film transistor T1. A drain of the first thin film transistor T1 is connected to receive the data signal DATA, a gate of the first thin film transistor T1 is connected to receive the scan signal SCAN, and a source of the first thin film transistor T1 is connected to the driving unit 20.

Referring to FIG. 4, in a second embodiment of the first object, the driving unit 20 comprises a second thin film transistor T2. A gate of the second thin film transistor T2 is connected to the source of the first thin film transistor T1, a drain of the second thin film transistor T2 is connected to the output terminal of the first light-emitting control unit 30, and a source of the second thin film transistor T2 is connected to an input terminal of the second light-emitting control unit 40.

Referring to FIG. 4, in one of the embodiments, the first light-emitting control unit 30 comprises a third thin film transistor T3. A drain of the third thin-film transistor T3 is connected to receive the power positive signal VDD, a gate of the third thin-film transistor T3 is connected to receive the first light-emitting control signal EM1, and a source of the third thin-film transistor T3 is connected to the drain of the second thin film transistor T2.

Referring to FIG. 4, in one of the embodiments, the second light-emitting control unit 40 comprises a fourth thin film transistor T4. A drain of the fourth thin film transistor T4 is connected to the source of the second thin film transistor T2, a gate of the fourth thin film transistor T4 is connected to receive the second light-emitting control signal EM2, and a source of the fourth thin film transistor T4 is connected to an input terminal of the light-emitting unit 50.

Referring to FIG. 4, in one of the embodiments, the light-emitting unit 50 comprises a light-emitting device D. An input terminal of the light-emitting device D is connected to the source of the fourth thin film transistor T4, and an output terminal of the light-emitting device D is connected to receive the power negative signal VSS.

It should be noted that the light-emitting device D may be, but not limited to, OLED, or self-luminous elements, such as LED.

Referring to FIG. 4, in one of the embodiments, the storage unit 60 comprises a first capacitor C1. A first terminal of the first capacitor C1 is connected to the gate of the second thin film transistor T2, and a second terminal of the first capacitor C1 is connected to the source of the second thin film transistor T2.

Referring to FIG. 4, in one of the embodiments, the voltage dividing unit 70 comprises a second capacitor C2. A first terminal of the second capacitor C2 is connected to receive the power positive signal VDD, and a second terminal of the second capacitor C2 is connected to the second terminal of the first capacitor C1.

Referring to FIG. 4, in one of the embodiments, the compensation unit 80 comprises a fifth thin film transistor T5. A drain of the fifth thin film transistor T5 is connected to receive the first reference signal VREF1, a gate of the fifth thin film transistor T5 is connected to receive the compensation signal COMP, and a source of the fifth thin film transistor T5 is connected to the first terminal of the first capacitor C1.

Referring to FIG. 4, in one of the embodiments, the reset unit 90 comprises a sixth thin film transistor T6, a drain of the sixth thin film transistor T6 is connected to receive the second reference signal VREF2, a gate of the sixth thin film transistor T6 is connected to receive the reset signal RST, and a source of the sixth thin film transistor T6 is connected to the second terminal of the second capacitor C2.

Referring to FIG. 4, in one of the embodiments, the first thin film transistor T1, the second thin film transistor T2, the third thin film transistor T3, the fourth thin film transistor T4, the fifth thin film transistor T5, and the sixth thin film transistor T6 are all N-type thin film transistors.

Figure 5:
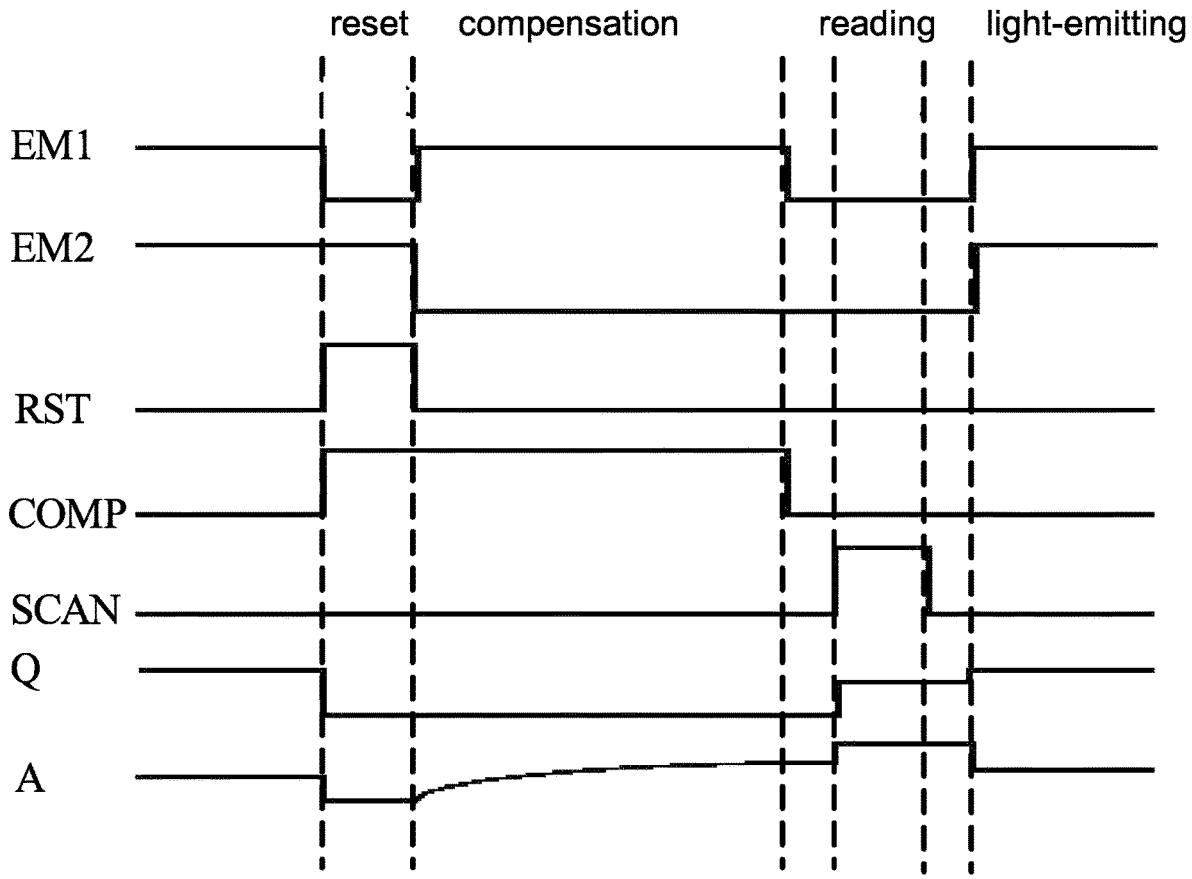
FIG. 5 is a timing diagram of the pixel circuit according to FIG. 4.

Referring to FIG. 5, an operation process of the pixel circuit in this embodiment includes the following stages.

In a reset stage, the reset signal RST, the second light-emitting control signal EM2, and the compensation signal COMP are all high-potential signals. The fourth thin-film transistor T4, the fifth thin-film transistor T5, and the sixth thin-film transistor T6 are turned on to reset the second capacitor C2 and the light-emitting device D. The fifth thin film transistor T5 resets a point Q to a potential of the first reference signal VREF1, the sixth thin film transistor T6 resets the second terminal of the storage unit 60 to a potential of the second reference signal VREF2. Meanwhile, the fourth thin film transistor T4 resets an input terminal of the light-emitting device D to a potential of the second reference signal VREF2.

In a compensation stage, both of the compensation signal COMP and the first light emission control signal EM1 are high potential signals. The second thin film transistor T2, the third thin film transistor T3, and the fifth thin film transistor T5 are all turned on to charge the first capacitor C1 and the second capacitor C2. The first capacitor C1 stores the threshold voltage Vth of the second thin film transistor T2. Point Q is maintained at the potential of the first reference signal VREF1. The potential at point A is the difference between the potential of the first reference signal VREF1 and the threshold voltage, that is, VREF1-Vth.

In a reading stage, the scanning signal SCAN is at a high potential, the first thin film transistor T1 is turned on, and the data signal DATA is read to the first capacitor C1. At this time, the potential of the point Q is the potential of the data signal DATA, that is, VDATA, and the potential at point A becomes VA, which is a source potential of the second thin film transistor T2, VA is described as the following formula.

$$VA = (VDATA - VREF1) \times \frac{C1}{C1 + C2} + VREF1 - Vth \quad \text{Equation I}$$

In a light-emitting stage, the first light-emitting control signal EM1 and the second light-emitting control signal EM2 are both high potential signals, the second thin film transistor T2 and the third thin film transistor T3 are turned on, and the light-emitting device D begins to emit light.

The current flowing through the light-emitting device D is described as the following formula.

$$I_{LED} = \frac{1}{2}\mu C_{OX}\frac{W}{L}(Vgs - Vth)^2 \quad \text{Equation II}$$

The potential of point Q VDATA and the potential of point A are preformed, i.e. Equation I is brought into Equation II, for obtaining the following Equation III.

$$I_{LED} = \frac{1}{2}\mu C_{OX}\frac{W}{L}\left[\left(VDATA = (VDATA - VREF1)\times\frac{C1}{C1+C2} - VREF1 + Vth\right) - Vth\right]^2 \quad \text{Equation III}$$

The Formula III is simplified to obtain the following Formula VI.

$$I_{LED} = \frac{1}{2}\mu C_{OX}\frac{W}{L}\left[(VDATA - VREF1)\times\frac{C2}{C1+C2}\right]^2 \quad \text{Equation VI}$$

Beside, μ is a carrier mobility, $C_{0x}$ is a oxide capacity per unit area, W/L is a width-to-length ratio of a T2 channel of the second thin-film transistor, Vth is the threshold voltage of the second thin-film transistor T2; VREF1 is the he potential of the first reference signal, VDATA is the potential of the data signal, C1 is the capacity of the first capacitor; C2 is the capacity of the second capacitor.

Figure 6:
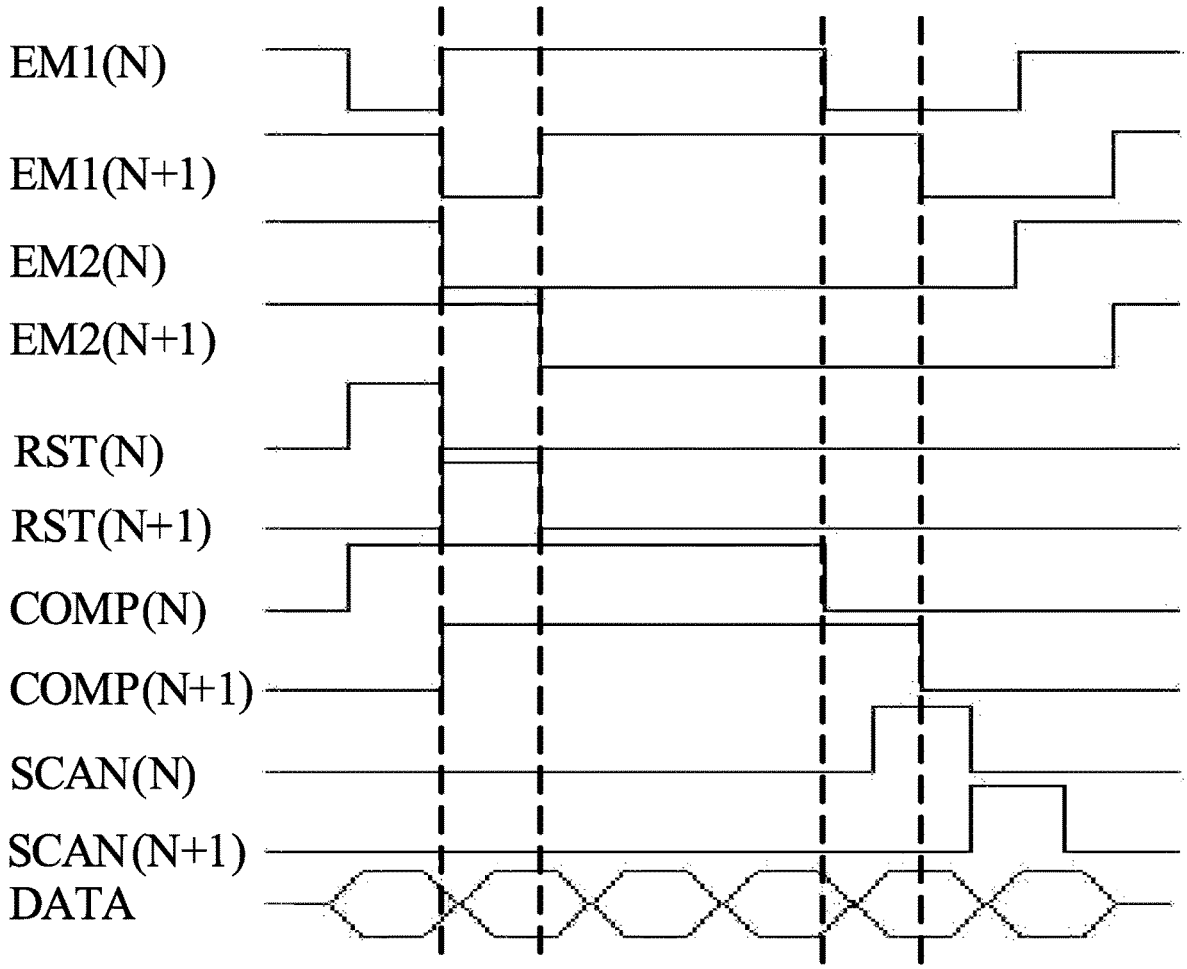
FIG. 6 is a timing diagram of multi-line operation of the pixel circuit according to FIG. 4.

In one of the embodiments, the disclosure provides a display panel, which is applied to a field of self-luminous display. The display panel comprises a plurality of rows of pixel circuits described in the above embodiment distributed in an array, and each row includes a plurality of the pixel circuits. Referring to FIG. 6, the pixel circuits in N row are controlled by the first light-emitting control signal EM1 (N) in the N row, the second light-emitting control signal EM2 (N) in the N row, the compensation signal COMP (N) in the N row, the reset signal RST (N) in the N row, and the scan signal SCAN (N) and the data signal DATA in the N row. The compensation stage and the reading stage are independent of each other, and the compensation stage is not limited by the duty cycle of the reading stage. For the same reason, the pixel circuits in N+1 row are controlled by the first light-emitting control signal EM1 (N+1) in the N+1 row, the second light-emitting control signal EM2 (N+1) in the N+1 row, the compensation signal COMP (N+1) in the N+1 row, the reset signal RST (N+1) in the N+1 row, and the scan signal SCAN (N+1) and the data signal DATA in the N+1 row. The compensation stage and the reading stage are independent of each other, and the compensation stage is not limited by the duty cycle of the reading stage. The pixel circuit of the N row and the pixel circuit of the N+1 row can also be performed simultaneously without mutual influence. Therefore, the disclosure provides a display panel, which is further suitable for applying in high frequency driving and provides better compensation effect.

This disclosure has been described with preferred embodiments thereof, and it is understood that many changes and modifications to the described embodiment can be carried out without departing from the scope and the spirit of the invention that is intended to be limited only by the appended claims.

What is claimed is:

1. A pixel circuit, comprising:

a switching unit configured to output a received data signal according to a control of a scanning signal;

a driving unit connected to an output terminal of the switching unit for accessing and driving pixels according to the data signal;

a first light-emitting control unit connected with an input terminal of the driving unit for outputting a received power positive signal according to a control of a first light-emitting control signal;

a second light-emitting control unit connected with an output terminal of the driving unit for outputting the power positive signal according to a control of a second light-emitting control signal;

a light-emitting unit connected to an output terminal of the second light-emitting control unit and connected to receive a power negative signal for display of the pixels;

a storage unit connected to the output terminal of the switching unit and the output terminal of the driving unit for storing a threshold voltage of the driving unit;

a voltage dividing unit connected to receive the power positive signal and connected with the output terminal of the driving unit for dividing a voltage of the storage unit;

a reset unit connected with the output terminal of the driving unit for pulling down a potential of the output terminal of the driving unit to a potential of a first reference signal according to a control of a reset signal; and a compensation unit connected to the output terminal of the switching unit, and configured to output a received second reference signal according to a compensation signal to compensate the threshold voltage;

wherein the reset unit includes a sixth thin film transistor, a drain of the sixth thin film transistor is connected to receive the second reference signal, a gate of the sixth thin film transistor is connected to receive the reset signal, and a source of the sixth thin film transistor is connected to the voltage dividing unit; and wherein a duty cycle of the scanning signal and a duty cycle of the compensation signal are in different time intervals.

2. The pixel circuit according to claim 1, wherein the switching unit comprises a first thin film transistor;

a drain of the first thin film transistor is connected to receive the data signal, a gate of the first thin film transistor is connected to receive the scanning signal, and a source of the first thin film transistor is connected to the driving unit.

3. The pixel circuit according to claim 2, wherein the driving unit comprises a second thin film transistor;

a gate of the second thin film transistor is connected to the source of the first thin film transistor, a drain of the second thin film transistor is connected to the output terminal of the first light-emitting control unit, and a source of the second thin film transistor is connected to an input terminal of the second light-emitting control unit.

4. The pixel circuit according to claim 3, wherein the first light-emitting control unit comprises a third thin film transistor;

a drain of the third thin-film transistor is connected to receive the power positive signal, a gate of the third thin-film transistor is connected to receive the first light-emitting control signal, and a source of the third thin-film transistor is connected to the drain of the second thin film transistor.

5. The pixel circuit according to claim 4, wherein the second light-emitting control unit comprises a fourth thin film transistor;

a drain of the fourth thin film transistor is connected to the source of the second thin film transistor, a gate of the fourth thin film transistor is connected to receive the second light-emitting control signal, and a source of the fourth thin film transistor is connected to an input terminal of the light-emitting unit.

6. The pixel circuit according to claim 5, wherein the light-emitting unit comprises a light-emitting device;

an input terminal of the light-emitting device is connected to the source of the fourth thin film transistor, and an output terminal of the light-emitting device is connected to receive the power negative signal.

7. The pixel circuit according to claim 6, wherein the storage unit comprises a first capacitor;

a first terminal of the first capacitor is connected to the gate of the second thin film transistor, and a second terminal of the first capacitor is connected to the source of the second thin film transistor.

8. The pixel circuit according to claim 7, wherein the voltage dividing unit comprises a second capacitor;

a first terminal of the second capacitor is connected to receive the power positive signal, and a second terminal of the second capacitor is connected to the second terminal of the first capacitor.

9. The pixel circuit according to claim 8, wherein the compensation unit comprises a fifth thin film transistor;

a drain of the fifth thin film transistor is connected to receive the first reference signal, a gate of the fifth thin film transistor is connected to receive the compensation signal, and a source of the fifth thin film transistor is connected to the first terminal of the first capacitor.

10. The pixel circuit according to claim 9, wherein the first thin film transistor, the second thin film transistor, the third thin film transistor, the fourth thin film transistor, the fifth thin film transistor, and the sixth thin film transistor are all N-type thin film transistors.

11. A display panel, comprising the pixel circuit according to claim 1.

* * * * *